US005156024A

United States Patent [19]

Schick

[11] Patent Number: 5,156,024

[45] Date of Patent: Oct. 20, 1992

[54] CARRIER OF CYLINDRICAL, ANNULAR, PLATE OR DISC FORM OR THE LIKE IN A CIRCULAR KNITTING MACHINE

[75] Inventor: Wilfried Schick, Bitz, Fed. Rep. of Germany

[73] Assignee: Sipra Patententwicklungs- und Beteiligungsgesellschaft mbH, Albstadt, Fed. Rep. of Germany

[21] Appl. No.: 728,554

[22] Filed: Jul. 11, 1991

[30] Foreign Application Priority Data

Jul. 30, 1990 [DE] Fed. Rep. of Germany ..... 4024101

[51] Int. Cl.[5] ..... D04B 35/30

[52] U.S. Cl. ..... 66/8

[58] Field of Search ..... 66/8, 115; 112/256; 165/104.22

[56] References Cited

U.S. PATENT DOCUMENTS

| | | | |
|---|---|---|---|
| 3,500,661 | 3/1970 | Köhler et al. | 66/8 |
| 3,561,565 | 2/1971 | Woor et al. | 66/8 X |
| 3,817,058 | 6/1974 | Lombardi | 66/8 |
| 4,205,708 | 6/1980 | Burbacher | 66/8 X |

FOREIGN PATENT DOCUMENTS

| | | | |
|---|---|---|---|
| 2600335 | 7/1976 | Fed. Rep. of Germany | 66/8 |
| 226921 | 9/1985 | German Democratic Rep. | 66/8 |
| 1305406 | 8/1985 | U.S.S.R. | 66/8 |
| 868428 | 5/1961 | United Kingdom | 66/8 |
| 2091302 | 7/1982 | United Kingdom | 66/8 |

*Primary Examiner*—Werner H. Schroeder
*Assistant Examiner*—John J. Calvert
*Attorney, Agent, or Firm*—Michael J. Striker

[57] ABSTRACT

The invention relates to a carrier (1) of annular, cylindrical, plate or disc form or the like in a circular knitting machine for mounting needles, sinkers, cam parts or the like. The carrier (1) comprises at least one flow channel, which serves for the transport of a gaseous or fluid medium intended for heat exchange and/or lubrication. This flow channel consists of a recess (9) formed in the carrier, adjoining a surface of the same, and a cover (10) covering the recess, sealed to the carrier (1) and comprises at least one connection (11, 12) for the feed and/or removal of the medium (FIG. 1).

16 Claims, 6 Drawing Sheets

CARRIER OF CYLINDRICAL, ANNULAR, PLATE OR DISC FORM OR THE LIKE IN A CIRCULAR KNITTING MACHINE

BACKGROUND OF THE INVENTION

This invention relates to a carrier in a circular knitting machine for mounting parts of a group of parts including at least needles, sinkers and cam parts, which carrier has at least one flow channel intended for the transport of a gaseous or fluid medium and comprising a recess formed in and adjoining a surface of the carrier.

In the operation of high performance knitting machines with large numbers of systems and speeds of rotation, especially large circular knitting machines with large diameters of e.g. 30", high frictional forces arise, which have their origin in the movements of the knitting implements (needles, jacks, sinkers or the like) relative to the carriers receiving the same (needle cylinder, dial, sinker ring or the like), or the cam parts controlling them, fixed to further carriers. These frictional forces do not only result in rapid wear of the rubbing partners and a high energy requirement for the circular knitting machine but also lead to such severe heating up to e.g. about 150° C. that the said parts can no longer be handled and necessary repairs, e.g. changing a broken needle, are only possible with special safety precautions or after adequate cooling of the circular knitting machine.

Apart from this, in circular knitting machines which run hot disturbances to operation, e.g. pattern errors or changes in the loop lengths or the yarn tension, which do not arise with cold or slow running machines, are frequently observed, even when the circular knitting machine is optimally adjusted at room temperature. These disturbances to operation must therefore be attributed to temperature effects, so that changing operating temperatures have an unfavourable influence on the functional reliability of a circular knitting machine. Finally it is known that circular knitting machines can tend to malfunction even on cold starting and that it can therefore be advantageous initially to allow them to warm up at a slow speed of rotation, before they are switched to the rated speed.

The sole possibility for providing effective relief has hitherto been the use of lubricating and/or heat exchange devices. These can for example comprise blowing or spray nozzles, by means of which gaseous heat exchange media, especially air, or fluid lubricants, especially oil, are blown or sprayed from the outside or the inside on to the knitting implements, their carriers and/or the cam arrangements, or heat exchange or lubricating circuits formed in the carriers, through which a fluid heat exchange or lubricating medium, especially water or oil, is fed. In an earlier proposal of the same applicants it has already been suggested to provide a heat exchange with at least two circuits for a fluid heat exchange medium, where the one circuit is associated with the carrier and the other circuit with the cam arrangement, in order thereby to moderate the temperature of the carrier and the cam arrangement in a controlled manner with their own associated circuits and so to control the heat exchange rate of at least one circuit in such a manner that substantially the same temperature difference between the carrier and the cam arrangement is established under all operating conditions of the circular knitting machine.

The technical realisation of such lubricating and/or heat exchange devices has however been deficient hitherto. A significant reason for this lies above all in that the formation of the heat exchange or lubricating channels in the carrier cannot be made sufficiently effective. These channels consist either of hose lines laid into channel-like recesses in the carrier (DE-OS 2 200 154), which do not make for a completely satisfactory heat exchange, or of channels and bores open on several sides (DE-OS 1 635 836) suited only to the use of air as heat exchange medium. Alternatively, open collecting channels are indeed known, which lead the heat exchange or lubricating medium to selected bores, from whence it is transported to a location provided for the heat exchange or lubrication (DE-PS 1 635 931), but such collecting channels are not always desirable on account of the sealing problems and on account of the high energy loss with necessary heating of the carrier.

SUMMARY OF THE INVENTION

It is, therefore, an object of this invention to design the carrier such that it is simple to produce. A further object underlying the invention is to simplify the sealing of the flow channels. Yet another object of this invention is to ensure the requirement for a good heat exchange between the flowing medium and the carrier. And yet another object of this invention is to make the use of additional hose lines or the like largely superfluous.

To solve these and other objects the carrier mentioned above is characterized in that the flow channel consists of a closed hollow space which is formed from the recess and a cover covering the recess and sealed to the carrier, and in that the hollow space is in communication with at least one connection for the supply and/or removal of the medium.

The invention brings with it the advantage that the heat exchange and/or lubricating medium channels are formed in the carrier itself as closed hollow voids, so that a directly effective and thus optimum heat exchange is facilitated when required, but they can be manufactured with comparatively simple means.

BRIEF DESCRIPTION OF THE DRAWINGS

The invention will be explained in more details below in conjunction with the accompanying drawings of embodiments. These show.

DETAILED DESCRIPTION OF THE PREFERRED EMBODIMENTS

Figure 1:
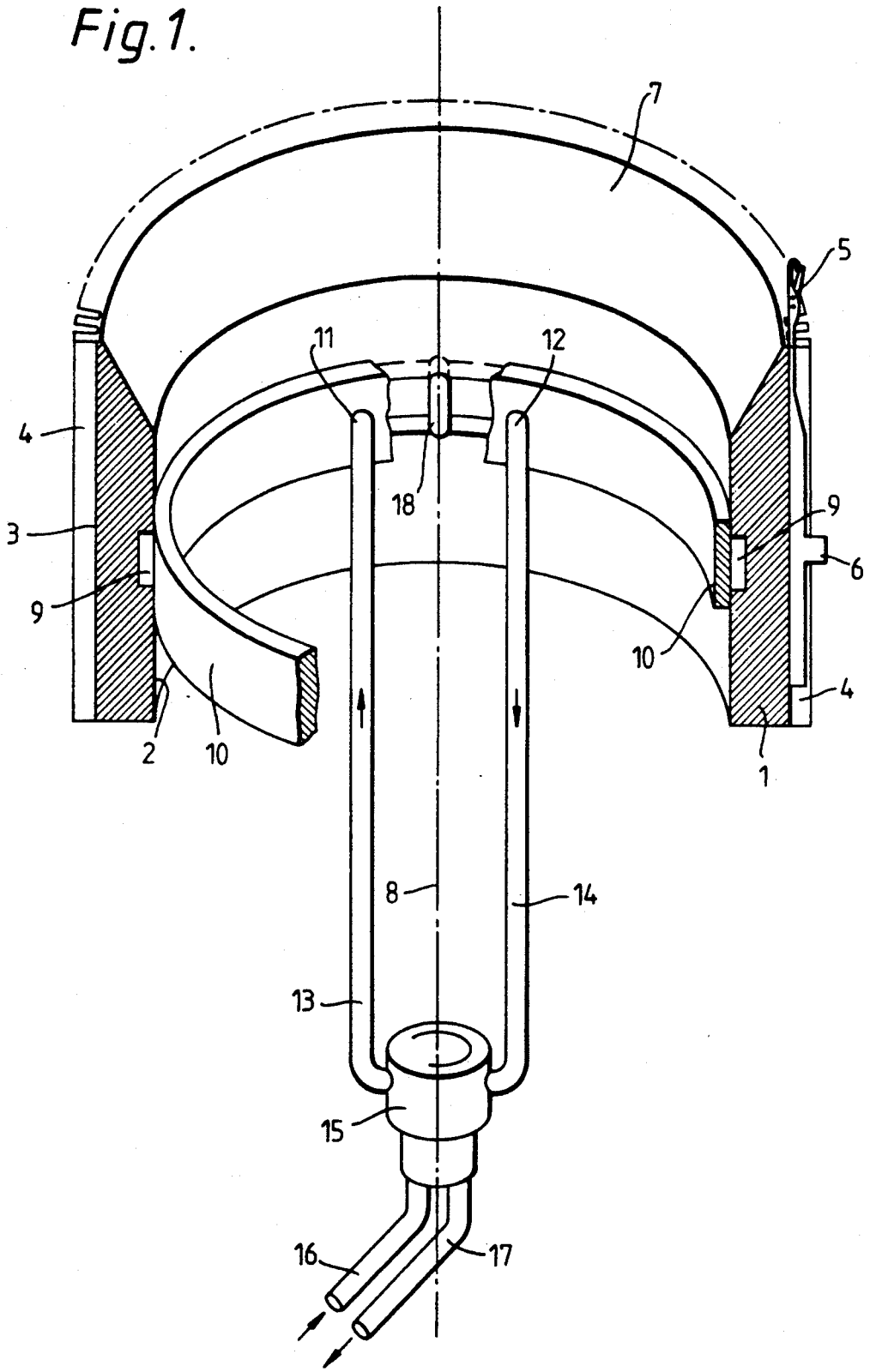
FIG. 1 a carrier according to the invention in the form of a needle cyclinder of a circular knitting machine in a schematic, perspective part view.

FIG. 1 shows a hollow, cylindrical carrier 1 of a circular knitting machine in the form of a needle cylinder with an inner peripheral surface 2 and an outer peripheral surface 3, from which project lands 4, between which there are slidably mounted knitting implements 5, here conventional latch needles with butts 6. The inner peripheral surface 2 of the carrier 1 is formed in conventional manner at its upper side with a guide surface 7 for the hose goods produced on the circular knitting machine, conically bevelled from below upwards and from inside outwards. The central axis of the needle cylinder is indicated by the reference numeral 8.

In accordance with the invention a recess 9 in the form of groove or channel is machined in the inner peripheral surface 2 of the needle cylinder, e.g. by turning or milling. The recess 9 preferably extends over the whole periphery of the inner peripheral surface 2 and is arranged substantially parallel to a plane running perpendicular to an axis 8. Alternatively it could be provided for the recess 9 to run in a plurality of spiral turns.

The open section of the recess 9 adjoining the inner peripheral surface 2 is covered by a cylindrical or annular cover 10, which is fixed in sealed manner to the carrier 1 and bears on the inner peripheral surface 2. The recess 9 and the cover 10 closing it on the outside thus form an annular void closed on all sides, or a flow channel, through which a gaseous or fluid medium, e.g. water or oil can be transported.

For the supply and removal of the medium the cover 10 is provided with at least one connection 11 and 12 respectively for an inlet and an outlet line 13 and 14 respectively. For the case in which the carrier 1 is arranged fixed in position, the lines 13, 14 are likewise arranged fixed in position and are connectible directly to a pump, not shown, a waste pipe or the like, the direction of flow being indicated by arrows. If however it is a circular knitting machine with a rotatable needle cylinder or carrier 1, then the free ends of the lines 13 and 14 are, since the latter rotate with the carrier 1, connected to the rotatable connections of a rotary feed through 15, whose stationary feed and waste lines 16, 17 are for example connected to feed and waste lines for the medium. Rotary through feeds 15 of this kind are generally known to the man in the art, since they are already used for fluff blow-off devices or cooling devices operating with air (DE-AS 1 113 786, DE-PS 3 101 154). However at present the best suited appear to be rotary through feeds such as are used for example in rotary machines, printing machines, in the paper industry, or the like and available for example from the Firm Deublin-Vertriebs GmbH of D-6238 Hofheim-Wallau (German Federal Republic). The rotary through feed is arranged for example on the bottom below the winding up device, the lines 13, 14 being led initially radially outwardly and then on the outer side of the knitted hose up to the connections 11, 12, so that the drawing off and the winding up of the knitted hose are not impeded.

In order that the medium shall not flow by the shortest path from the connection 11 to the connection 12 in operation of the circular knitting machine, a partition 18 is advantageously provided in the recess 9 between the connections 11, 12, which adjoins the cover 10 and may permit a small leakage flow.

Figure 2:
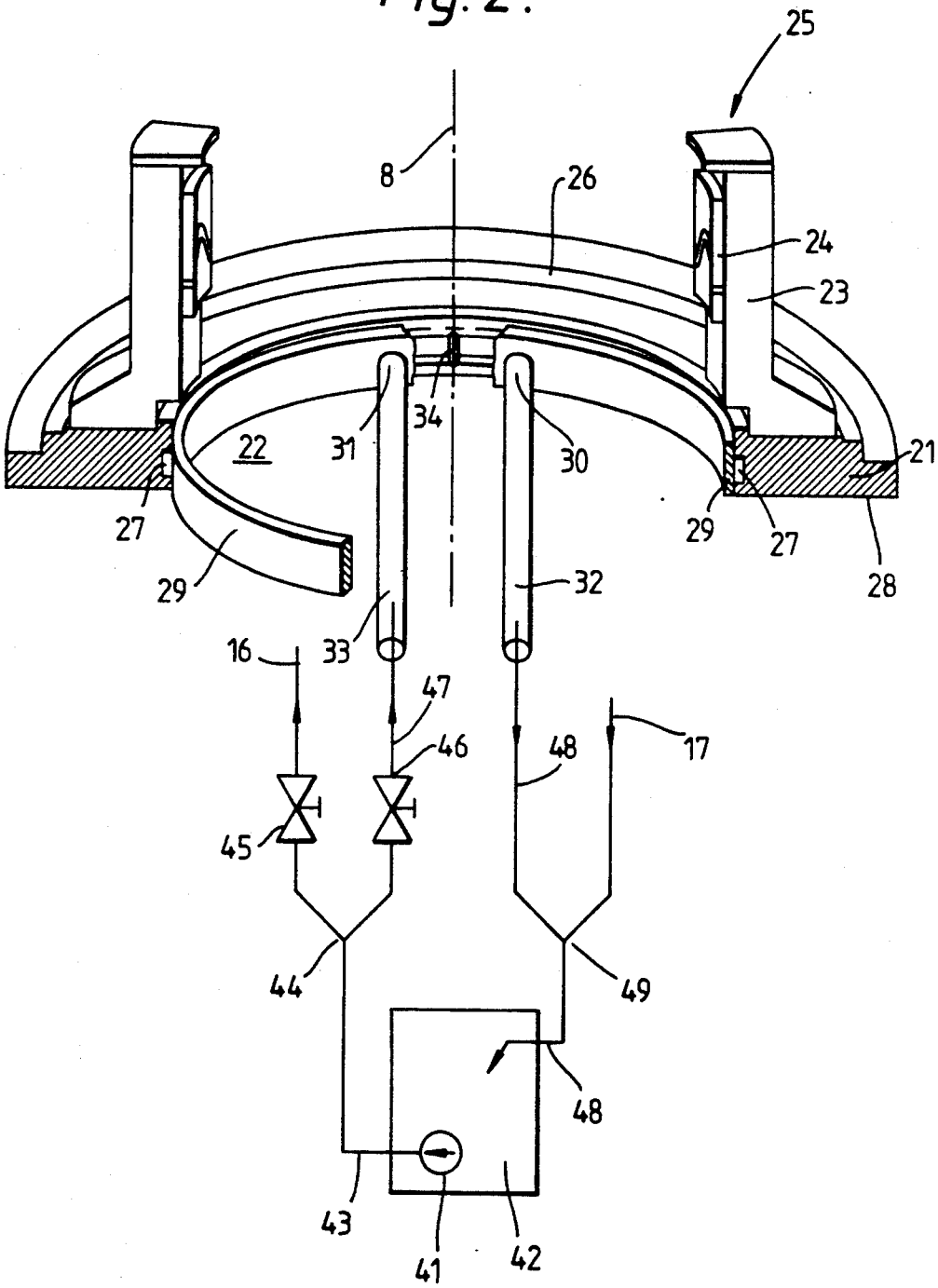
FIG. 2 a carrier according to the invention in the form of an annular cam plate of a circular knitting machine in a schematic, perspective part view.

In the embodiment according to FIG. 2 there is provided a carrier 21 in the form of an annular cam plate, which is mounted in fixed position on the frame of a machine for example and has an opening 22 for reception of a rotatably mounted needle cylinder, which can be the carrier 1 according to FIG. 1 for example. Alternatively it would be possible to mount the carrier 21 rotatably and the carrier 1 in fixed position. The axis of rotation is indicated at 8 as in FIG. 1. On the carrier 21 there are mounted a number of segments 23, which are provided on their inner sides with cam parts 24, which serve in customary manner to control the butts 6 of the knitting implements (FIG. 1) and form a conventional cam arrangement 25 with the carrier 21 and the segments 23.

In an inner peripheral surface 26 of the carrier 21 there is machined, e.g. by turning or milling, a recess 27 in the form of a groove or a channel. The recess 27 is preferably continued over the whole periphery of the inner peripheral surface 26 and arranged substantially parallel to a plane running perpendicular to the axis 8. Alternatively it could be provided e.g. that the recess 27 is formed in a bottom surface 28, an outer peripheral surface or in an upper peripheral surface of the carrier 21.

The open section of the recess 27 adjoining the inner peripheral surface 26 is covered by a cylindrical or annular cover 29, which is fixed in sealed manner to the carrier 21 and bears on the inner peripheral surface 26. The recess 27 and the cover 29 closing it on the outside thus form an annular void closed on all sides, or a flow channel, through which a gaseous or fluid medium can flow as lubricating and/or heat exchange medium.

For the supply and removal of the medium the cover 29 is provided with at least one connection 30 and 31 respectively for an inlet and an outlet line 32 and 33 respectively, the direction of flow being indicated by arrows. As in the embodiment according to FIG. 1, in the case when the carrier 21 is mounted rotatably about the axis 8, and with it the lines 32, 33, a rotary feed through connected to the lines 32, 33 can additionally be provided. Between the two lines 32, 33 there is again advantageously provided a partition 34 projecting from the bottom of the recess 27 to the cover 29.

The channels formed by the recesses 9, 27 and covers 10 29, closed on all sides, are preferably components of a circuit of a heat exchanger device of the circular knitting machine, intended for a heat exchange with the carrier 1, 21, where e.g. water is provided as heat exchange medium.

For the control of the two closed circuits according to FIGS. 1 and 2 the arrangement shown in FIG. 2 can serve for example. The heat exchange medium is pumped from a reservoir 42 by means of a pump 41 into a feed line 43, which is connected via a branch 44 in each case to a device 45, 46 for adjusting the flow quantity. The device 45 is connected e.g. to the feed line 16 of the rotary feed through 15 (FIG. 1) and the device 46 to a feed line for the pipeline 33. The return flow is effected over a return flow line 48, which is connected via a branch 49 both to the outflow line 32 (FIG. 2) and also to the outflow line 17 of the rotary feed through 15 (FIG. 1) and is returned to the reservoir 42. By adjusting the flow quantities by means of the devices 45, 46, the total flow of the heat exchange medium can be so proportioned between the carriers 1, 21 that the desired temperature relationship is obtained. Correspondingly the described arrangement could also serve to feed a lubricant, e.g. oil, to the recesses 9 or 27 serving as ring channels; the lubricant then could be fed further from the ring channels to the components to be lubricated, knitting implements or the like, as is known per se. In such a case the outflow lines can be omitted. Also combined cooling (warming) and lubricating devices of the said kind are possible. Finally cooling or heating devices, not shown, could be associated with the described arrangements, in order to cool or heat the heat exchange or lubricating medium in question to the desired temperature.

Details of the hollow spaces or channels carrying the various media appear from FIGS. 3 to 13.

Figure 3:
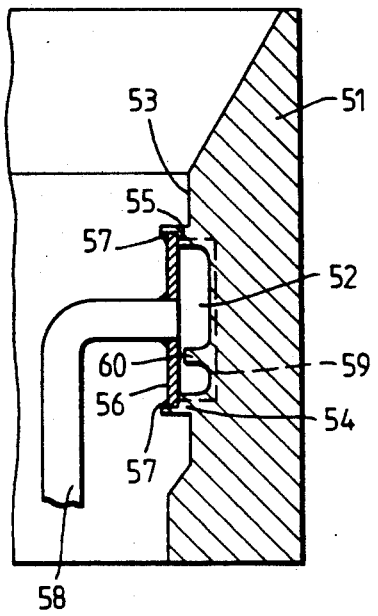
FIG. 3 a vertical section, enlarged relative to FIG. 1, through one half of the needle cylinder, along the line III—III of FIG. 4.
Figure 4:
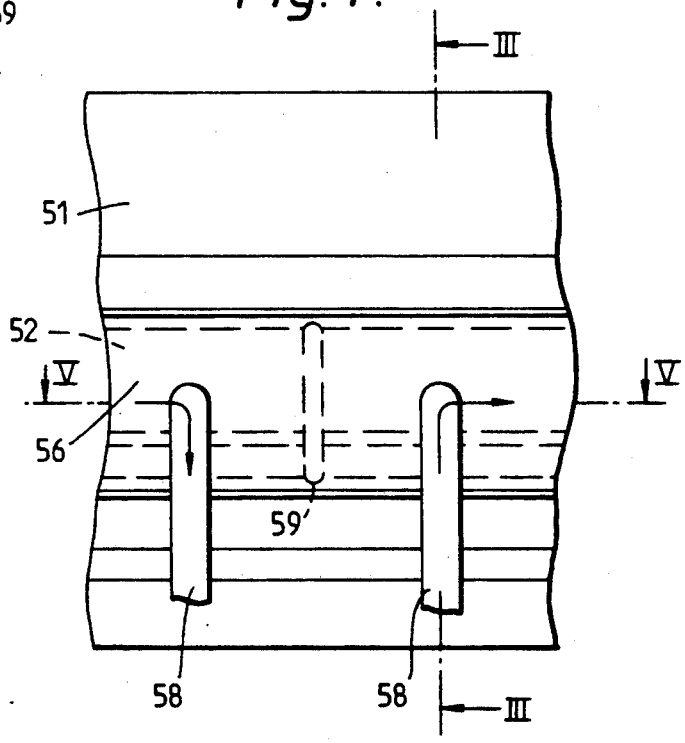
FIG. 4 a view of one part of an inner peripheral surface of the needle cylinder according to FIG. 3.
Figure 5:
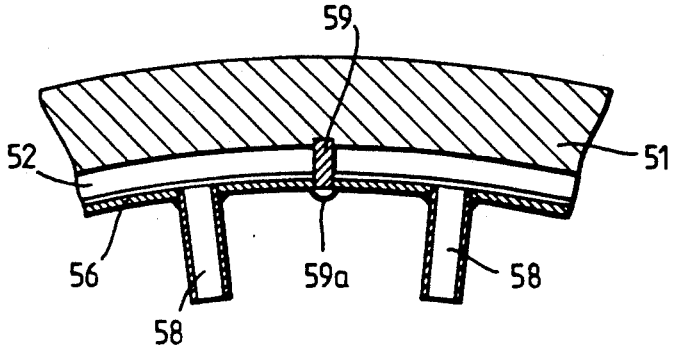
FIG. 5 a section along the line V—V of FIG. 4.

According to FIGS. 3 to 5 there is formed in a hollow cylindrical carrier 51 a recess 52, which adjoins an inner peripheral surface 53 and extends annularly. At each of its long sides the recess 52 is bounded by a thin walled projection 54 attached to the inner peripheral surface 53, which projections has a shoulder acting as an abutment surface 55 for a cover 56. The cover 56 consists for example of a sheet metal ring capable of being bent or otherwise flexible, which can be fitted with slight deformation from the inside of the carrier 51 on the abutment surfaces 55 located between the projections 54. The fixing is effected for example by soldering or welding, as is indicated by weld points 57. Alternatively a screw joint could equally be provided. The projections 54 are preferably so formed that they facilitate a rapid conduction of heat in the welding or soldering operation and thus prevent deformations or the like, which could lead to fracture of the welded or soldered joint.

The cover 56 is provided with connections 58, which are fixed to it likewise by welding or soldering for example. A partition 59 formed in the recess 52, extending up to the cover 56 separates these connections from one another. The partition 59 can also pass through a slot provided in the cover 56 and be sealed by a special seal 59*a* (FIG. 5). The recess 53 can also for example have additional webs 60, which form ribs and channels in the carrier 51 or in the recess 52 and thus substantially increase the effective surface for the heat exchange medium in the recess 52.

Figure 6:
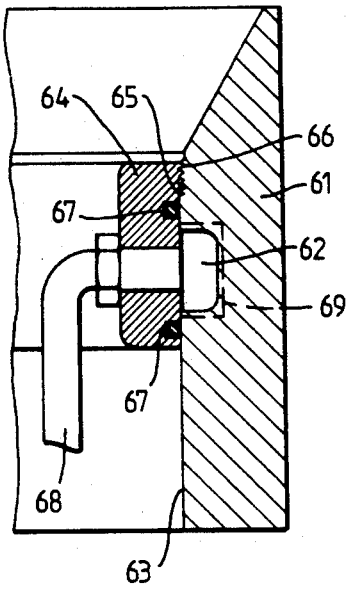
FIGS. 6 to 13 representations corresponding to FIGS. 3 and 4 of further embodiments of the carrier according to the invention.
Figure 7:
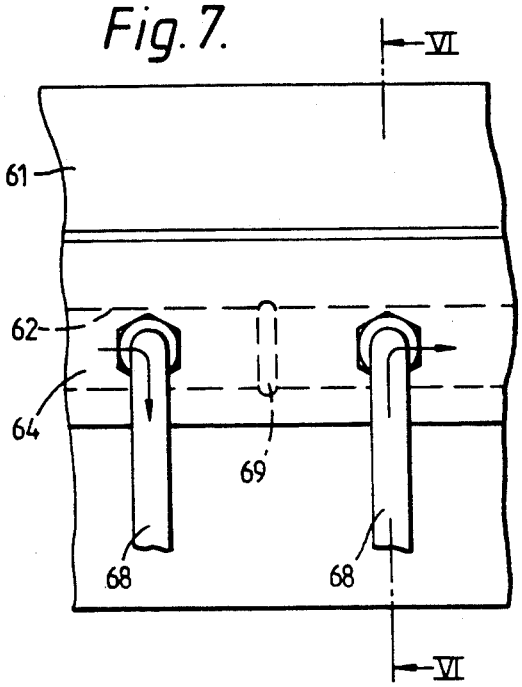

In the embodiment according to FIGS. 6 and 7 a hollow cylindrical carrier 61 is provided with a recess 62, which is machined in an inner peripheral surface 63. A cover 64 for this recess 62 consists of a rigid hollow sleeve or a rigid cylindrical ring, which is provided at its upper end with an external threaded section 65, which cooperates with a corresponding internal threaded section 66 of the inner peripheral surface 63 and serves to fix the cover 64 to the carrier 61. To avoid too small tolerances there are arranged on the two sides of the recess 62 elastic sealing bodies 67, e.g. circumferential O-rings, preferably in grooves of the cover 64 and/or of the inner peripheral surface 63, which bodies are deformed elastically on screwing up the cover 64 and seal the recess 62 hermetically.

In correspondence with FIGS. 3 and 4 there are provided connections 68 fitted in the cover 64 and a partition 69 projecting into the recess 62.

Figure 8:
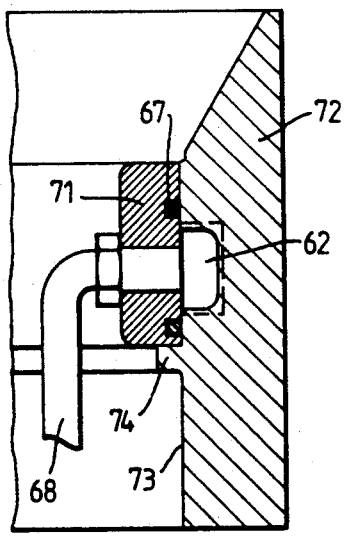
Figure 9:
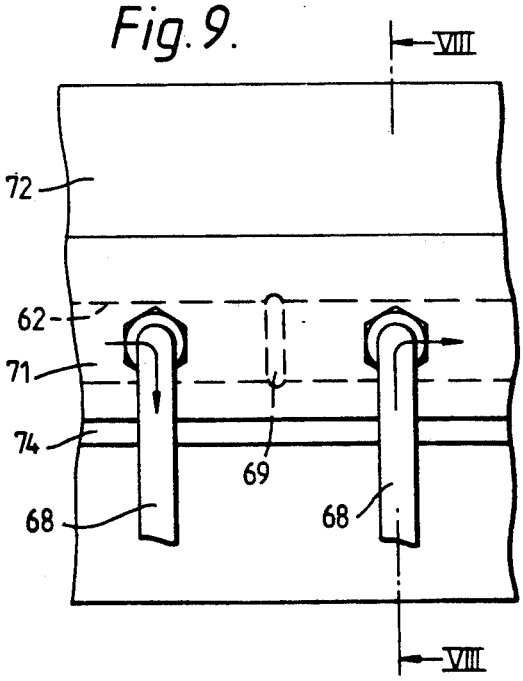

The embodiment according to FIGS. 8 and 9 corresponds in substance to that according to FIGS. 6 and 7, so that like parts are provided with the same reference numerals. The differences are merely a thicker cover 71, which, in contrast to FIGS. 6 and 7 has no external threaded section and a carrier 72 which has no internal threaded section, but an annular projection 74 instead, projecting from the inner peripheral surface 73, which projection could consist of a plurality of short projections extending over a small part of the peripheral surface. Since the carrier 72 is arranged as a rule inside the circular knitting machine with a vertical axis, the fixing of the cover can be effected simply in that this is introduced to the carrier 72 and placed on the projection 74. The sealing is again catered for by the sealing bodies 67, which moreover fix the cover 71 in position by a press fit.

Figure 10:
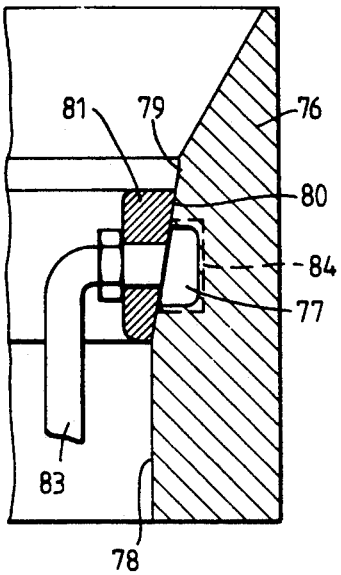
Figure 11:
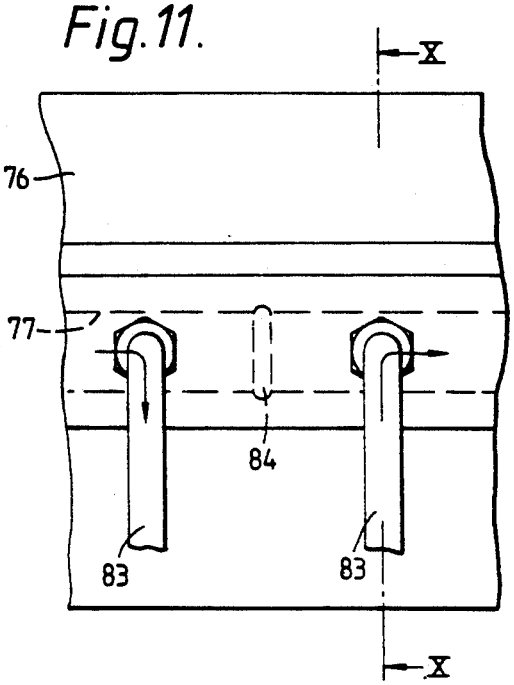
Figure 12:
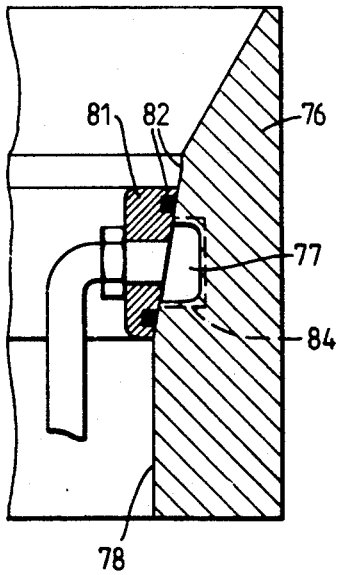
Figure 13:
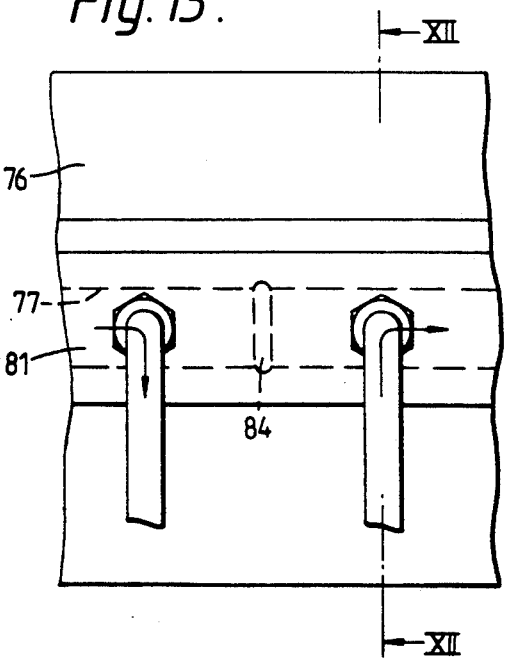

In the embodiment according to FIGS. 10 and 11 a hollow cylindrical carrier 76 is provided with a recess 77, which adjoins an inner peripheral surface 78. In contrast to the embodiments according to FIGS. 1 to 9, this peripheral surface 78 is not cylindrical in the region of the recess 77, but is provided with a conical surface 79, whose inner diameter reduces slightly in FIG. 10 from above down. Accordingly an outer peripheral surface of a cover 81 formed as a cylindrical ring or sleeve is shaped as a conical surface, so that the cover 81 is fitted from above into the carrier 76 and can be fixed in this in accordance with FIG. 10 through a force fit. The two conical surfaces 79 and 80 extend for example over about 40 mm with a cone angle of e.g. 5°. With high quality cooperating cone surfaces 79, 80 no additional sealing is needed, although in the embodiment at present appearing the best, according to FIGS. 12 and 13, in which like parts are given the same reference numerals, additional sealing bodies 82 in the form on O-rings or the like can be provided in correspondence with FIGS. 6 to 9. The required quality of the surfaces can thereby be reduced or the tolerances to be maintained increased.

In addition a partition 84 can be provided, as in the other embodiments, between connections 83.

The illustrated covers 56, 64, 71 and 81 could alternatively be bonded to the associated inner peripheral surfaces 53, 63, 73 and 79 respectively. For this purpose there are suited various adhesives which can be obtained in the trade under the name Loctite. Through this there are ensured both a permanent fixing and hermetic sealing.

Figure 14:
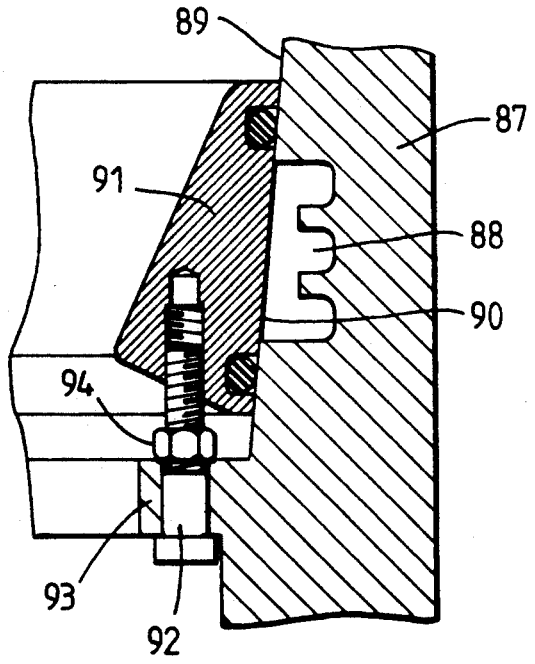
FIG. 14 a representation corresponding to FIG. 6 of a further embodiment of the invention.

As an alternative to bonding screwing is also possible, as is shown in FIG. 14. As in the embodiments according to FIGS. 10 to 13 a hollow cylindrical carrier 87 is provided with a recess 88, which adjoins an inner peripheral surface 89 formed as a conical surface, whose inner diameter reduces slightly in FIG. 14 from above downwards. Accordingly an outer peripheral surface 90 of a sleeve-like cover 91 is formed as a conical surface with a cone angle corresponding to the peripheral surface 89, so that the cover 91 is fitted from above into the carrier 87 and can be fixed therein as a force fit.

For the firm fixing of the cover 91 on the carrier 87 there serve fixing screws 92, which pass through bores of an inner support ring 93 of the carrier 87, are screwed into threaded bores of the cover 91 and are distributed at intervals in the circumferential direction. The cover 91 is thereby drawn against the conical surface 89 and therefore has an accurate seating, so that possible inaccuracies or faults arising from temperature variations are extremely unlikely. The existing adjustment is additionally secured with lock nuts 94. A corresponding mode of fixing can be provided for fixing the cover on other carrier, e.g. that according to FIG. 2.

The invention is not limited to the described embodiments, which can be modified in many ways. This applies both to the geometry of the described covers and the associated receiving surfaces and also to the sealing means used in the particular cases. Moreover it is not necessary, in contrast to the described embodiments, to make the channels formed in the carrier to conduct the heat exchange or lubricating medium circumferential. According to the intended use it can rather also be provided that these channels only extend over a part of the circumference of the carrier in question. In this case the sealing bodies, insofar as needed, are advantageously not formed as O-rings but as endless sealing bodies around the outer contour of the recesses, which bodies preferably also consist of round cord material. Apart from this the covers do not have to be made from sheet metal, as described. Rather other materials such as steel, plastics or the like are suitable, where the covers can be made according to the embodiment as bodies which are rigid or highly resistant to bending or as flexible, bending strips. It is further possible to fix the connections not to the cover but to the carrier, in that this is for example provided with bores, which extend from its outer peripheral surface to the recesses, which can facilitate access to the connections especially with circular knitting machines with stationary carriers. In this case it can also be advantageous to form the recesses e.g. from the outer peripheral surface and to mount the covers correspondingly on the outside, so long as the access to the circular knitting machine or its parts is not hindered unacceptably.

Even if only hollow cylindrical carriers and carriers in the form of an annular cam plate are described above, it is obvious to the expert that the invention can also be applied to other carriers, particularly to carriers of cylindrical, annular, plate or disc form or the like for mounting needles, sinkers, jacks and cam parts or the like.

While the invention has been illustrated and described as embodied in a large diameter circular knitting machine having knitting needles in the cylinder and sinkers in the sinker ring, it is not intended to be limited to the details shown, since various modifiactions and structural changes may be made without departing in any way from the spirit of the present invention, particularly with respect to other circular and flat knitting machines.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be proctected by Letters Patent is set forth in the appended claims.

1. Carrier in a circular knitting machine for mounting parts of a group including at least needles, sinkers and cam parts and having at least one flow channel intended for transporting a gaseous or fluid medium, said flow channel comprising a recess being formed in the carrier and adjoining a surface of said carrier, and consisting of a closed hollow space formed from the recess and a cover covering the recess and sealed to the carrier, and the hollow space being in communication with at least one connection for movement of the medium.

2. Carrier according to claim 1, wherein said connection is formed on the cover.

3. Carrier according to claim 1 wherein said flow channel is formed in encircling manner and is provided with a partition having two sides and wherein at least one connection is formed on each of the two sides of the partition.

4. Carrier according to claim 1 further being formed in hollow, cylindrical manner, the recess adjoining an inner peripheral surface of the carrier and the cover consisting of a hollow cylindrical sleeve fitted to inner peripheral surface.

5. Carrier according to claim 4, wherein the inner peripheral surface of the carrier has a thin walled projection on each of two sides of the recess and wherein the cover is fixed to the projections.

6. Carrier according to claim 4, characterized in that the cover consists of a flexible strip.

7. Carrier according to claim 4, wherein the inner peripheral surface of the carrier is provided with an inner threaded section and an outer peripheral surface of the cover is provided with a corresponding outer threaded section which can be screwed into the inner threaded section.

8. Carrier according to claim 4, wherein the inner peripheral surface is formed as a conical surface on each of two sides of the recess and the cover is provided with a correspondingly formed conical surface on its outer surface cooperating therewith.

9. Carrier according to claim 4, wherein the cover consists of a rigid, hollow cylindrical sleeve and a projection is provided on the inner peripheral surface for mounting the sleeve.

10. Carrier according to claim 1, wherein the cover is bonded to the carrier.

11. Carrier according to claim 1, wherein the cover is provided on each of two sides of the recess with a sealing body for sealing the flow channel.

12. Carrier according to claim 1 wherein the carrier is provided on each of two sides of the recess on said cover with a sealing body for sealing the flow channel.

13. Carrier according to claim 11 or 12, wherein the sealing body consists of an O-ring.

14. Carrier according to claim 1, wherein at least one web projects from the recess.

15. Carrier according to claim 1, wherein the cover is screwed to the carrier.

16. Carrier according to claim 15, wherein the carrier has a support ring projecting inwardly from an inner peripheral surface, and wherein fixing screws are provided which project through said supporting ring and are screwed into the cover.

* * * * *